US010498055B2

(12) United States Patent
Chen et al.

(10) Patent No.: US 10,498,055 B2
(45) Date of Patent: Dec. 3, 2019

(54) BOARD TO BOARD CONNECTOR ASSEMBLY

(71) Applicant: Tarng Yu Enterprise co., ltd., New Taipei (TW)

(72) Inventors: Ying-Chung Chen, New Taipei (TW); Mu-Jung Huang, New Taipei (TW)

(73) Assignee: TARNG YU ENTERPRISE CO., LTD., New Taipei (TW)

( * ) Notice: Subject to any disclaimer, the term of this patent is extended or adjusted under 35 U.S.C. 154(b) by 146 days.

(21) Appl. No.: 15/486,296

(22) Filed: Apr. 12, 2017

(65) Prior Publication Data

US 2018/0151967 A1 May 31, 2018

(30) Foreign Application Priority Data

Nov. 25, 2016 (TW) ..... 105218070 U

(51) Int. Cl.

| | |
|---|---|
| ***H01R 12/52*** | (2011.01) |
| ***H01R 4/02*** | (2006.01) |
| ***H01R 12/57*** | (2011.01) |
| ***H01R 12/70*** | (2011.01) |
| ***H01R 12/71*** | (2011.01) |
| ***H01R 13/6581*** | (2011.01) |

(52) U.S. Cl.

CPC ..... *H01R 12/52* (2013.01); *H01R 4/02* (2013.01); *H01R 12/57* (2013.01); *H01R 12/7005* (2013.01); *H01R 12/716* (2013.01); *H01R 13/6581* (2013.01)

(58) Field of Classification Search

CPC ..... H01R 13/6275; H01R 13/6594; H01R 12/716

USPC ..... 439/607.35, 607.36, 74, 101, 108

See application file for complete search history.

(56) References Cited

U.S. PATENT DOCUMENTS

| | | | | |
|---|---|---|---|---|
| 5,915,976 | A * | 6/1999 | McHugh | H01R 23/6873 439/108 |
| 7,059,908 | B2 * | 6/2006 | Yamaguchi | H01R 23/6873 439/607.17 |
| 7,632,107 | B2 * | 12/2009 | Mizumura | H01R 23/68 439/108 |
| 9,425,526 | B2 * | 8/2016 | Uratani | H01R 13/6473 |
| 2017/0033505 | A1 * | 2/2017 | Ozeki | H01R 12/716 |

* cited by examiner

*Primary Examiner* — Amy Cohen Johnson
*Assistant Examiner* — Paul D Baillargeon
(74) *Attorney, Agent, or Firm* — Chun-Ming Shih; LanWay IPR Services

(57) ABSTRACT

A board to board connector assembly includes a male board connector, a female board connector, and an engagement structure for effectively engaging the male board connector with the female board connector. This assures effective engagement between the female and male board connectors even in the case of insufficient contact area therebetween, such that height of engagement between the female and male board connectors can be reduced desirably, making the board to board connector assembly well applicable to various miniaturized electronic devices. Moreover, the board to board connector assembly of the invention includes a plurality of conductors for simultaneously transmitting various signals, such that the number of connectors used in the electronic devices can be reduced. This also allows the board to board connector assembly to be readily applied to various miniaturized electronic devices.

11 Claims, 13 Drawing Sheets

BOARD TO BOARD CONNECTOR ASSEMBLY

CROSS-REFERENCE TO RELATED APPLICATIONS

This application claims the priority of Republic of China Patent Application No. 105218070 filed on Nov. 25, 2016, in the State Intellectual Property Office of the R.O.C., the disclosure of which is incorporated herein by reference.

BACKGROUND OF THE INVENTION

Field of the Invention

The invention relates to connector assemblies, and more particularly, to a board to board connector assembly for transmitting radio frequency signals.

Descriptions of the Related Art

Electronic devices are widely applied nowadays due to rapid development of electronic technology. A plurality of circuit substrates with various functions are provided in the electronic devices to meet users' requirements, wherein radio frequency (RF) signal cables are usually placed in the electronic devices for transmitting signals between the circuit substrates. As the electronic devices have become lighter and thinner, there is not enough space inside the electronic devices for accommodating the RF signal cables, and thus board to board connectors have been made available for transmitting RF signals between the circuit substrates without the use of RF signal cables.

Recently height of engagement between the board to board connectors has been decreasing as desired, which however leads to insufficient contact area between the board to board connectors and weakens engagement force therebetween. When the board to board connectors are subject to external impact, they would easily become separated, thereby affecting normal operation of the electronic devices and even damaging the electronic devices.

Therefore, how to improve the structure of board to board connectors to achieve effective engagement and reduced height of engagement between the board to board connectors is an important topic in the art.

SUMMARY OF THE INVENTION

In view of the above drawbacks of the conventional technology, a primary object of the invention is to provide a board to board connector assembly for signal transmission between a first circuit substrate and a second circuit substrate, the board to board connector assembly including: a male board connector, including: a male insulator including a male insulator supporting portion; a plurality of male conductors, each of the male conductors including a male conductor matching portion and a male conductor soldering portion, wherein the male conductors are embedded in the male insulator, allowing the male conductor matching portions to cross above the male insulator supporting portion and to be exposed from a top side of the male insulator, and allowing the male conductor soldering portions to be extended out of a bottom side of the male insulator, wherein the male conductor soldering portions are for being soldered to the first circuit substrate, and the male insulator supporting portion supports the male conductor matching portions and allows them to remain protruded on the male insulator;

and a male shield coupled to the male insulator and forming a male shielding area surrounding peripherally the male insulator, the male shield including a male shield matching portion, a male shield coupling portion and a male shield soldering portion, wherein the male shield soldering portion is for being soldered to the first circuit substrate, the male conductor soldering portions are extended into the male shielding area, and the male shield soldering portion is extended out of the male shielding area; and a female board connector, including: a female insulator including a female insulator penetrating portion; a plurality of female conductors, each of the female conductors including a female conductor matching portion and a female conductor soldering portion, wherein the female conductors are inserted into the female insulator penetrating portion, allowing the female conductor matching portions to be exposed from a top side of the female insulator, and allowing the female conductor soldering portions to be extended out of a bottom side of the female insulator, wherein the female conductor soldering portions are for being soldered to the second circuit substrate; and a female shield embedded in the female insulator and surrounding peripherally the female insulator, the female shield including a female shield matching portion, a female shield coupling portion and a female shield soldering portion, wherein the female shield soldering portion is for being soldered to the second circuit substrate; wherein, the male board connector is inserted to the female board connector, wherein the male shield coupling portion is coupled to the female shield coupling portion, the male conductor matching portions match the female conductor matching portions, and the male shield matching portion matches the female shield matching portion, so as to allow the male board connector to be electrically connected to the female board connector.

In a preferred embodiment of the present invention, each of the female conductors includes a female conductor coupling portion for being coupled to the female insulator. Optionally, the female conductor coupling portions of the female conductors are coupling blocks protruded from the female conductors, and the female insulator penetrating portion includes a coupling wall that structurally matches the coupling blocks so as to allow the female conductors to be coupled to the female insulator.

In a preferred embodiment of the present invention, the female shield forms a female shielding area surrounding peripherally the male insulator, and the female conductor soldering portions and the female shield soldering portion are extended out of the female shielding area. Optionally, the male shielding area is larger than the female shielding area.

In a preferred embodiment of the present invention, the male shield coupling portion includes at least one male shield coupling slot, and the female shield coupling portion includes at least one female shield coupling block that structurally matches the at least one male shield coupling slot, so as to allow the male shield coupling portion to be coupled to the female shield coupling portion. Optionally, the at least one male shield coupling slot includes a plurality of male shield coupling slots respectively provided on inner peripheral walls of the male shield, and the at least one female shield coupling block includes a plurality of female shield coupling blocks respectively provided on outer peripheral walls of the female shield. Optionally, the male conductor coupling portion includes at least one male conductor coupling slot, and the female conductor coupling portion includes at least one female conductor coupling block that structurally matches the at least one male conductor coupling slot, so as to allow each of the plurality of male conductors to be coupled to a corresponding one of the plurality of female conductors.

In a preferred embodiment of the present invention, each of the plurality of male conductors includes a male conductor coupling portion, and each of the plurality of female conductors includes a female conductor coupling portion that structurally matches the male conductor coupling portion, so as to allow each of the plurality of male conductors to be coupled to a corresponding one of the plurality of female conductors.

In a preferred embodiment of the present invention, the male shield further includes a male shield engaging portion, and the male insulator further includes a male insulator engaging portion that structurally matches the male shield engaging portion, so as to allow the male shield to be engaged with the male insulator. Optionally, the male shield engaging portion includes at least one male shield engaging slot, and the male insulator engaging portion includes at least one male insulator engaging block that structurally matches the at least one male shield engaging slot, so as to allow the male shield engaging portion to be engaged with the male insulator engaging portion. Optionally, the at least one male shield engaging slot includes a plurality of male shield engaging slots respectively provided on inner peripheral walls of the male shield, and the at least one male insulator engaging block includes a plurality of male insulator engaging blocks respectively provided on outer peripheral walls of the male insulator.

In a preferred embodiment of the present invention, the female shield further includes a female shield engaging portion, and the female insulator further includes a female insulator engaging portion that structurally matches the female shield engaging portion, so as to allow the female shield to be engaged with the female insulator. Optionally, the female shield engaging portion includes at least one female shield engaging slot, and the female insulator engaging portion includes at least one female insulator engaging block that structurally matches the at least one female shield engaging slot, so as to allow the female shield engaging portion to be engaged with the female insulator engaging portion. Optionally, the at least one female shield engaging slot includes a plurality of female shield engaging slots respectively provided on a plurality of peripheral corners of the female shield, and the at least one female insulator engaging block includes a plurality of female insulator engaging block respectively provided on a plurality of peripheral corners of the female insulator.

In a preferred embodiment of the present invention, the male board connector and the female board connector are rectangular bodies, wherein the male board connector includes eight male conductors, and the female board connector includes eight female conductors. the male shield further includes a male shield guiding portion, and the female shield further includes a female shield guiding portion that structurally matches the male shield guiding portion, so as to allow the male board connector to be guided and inserted to the female board connector.

Compared to the conventional technology, the invention provides a board to board connector assembly, which includes a male board connector, a female board connector, and an engagement structure for effectively engaging the male board connector with the female board connector. This assures effective engagement between the female and male board connectors even in the case of insufficient contact area therebetween, such that height of engagement between the female and male board connectors can be reduced desirably, making the board to board connector assembly well applicable to miniaturized electronic devices such as mobile communication equipment. Moreover, the board to board connector assembly of the invention includes a plurality of conductors for simultaneously transmitting various signals, such that the number of connectors used in the electronic devices can be reduced. This also allows the board to board connector assembly to be readily applied to various miniaturized electronic devices such as mobile communication equipment.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE PREFERRED EMBODIMENT

Figure 1:
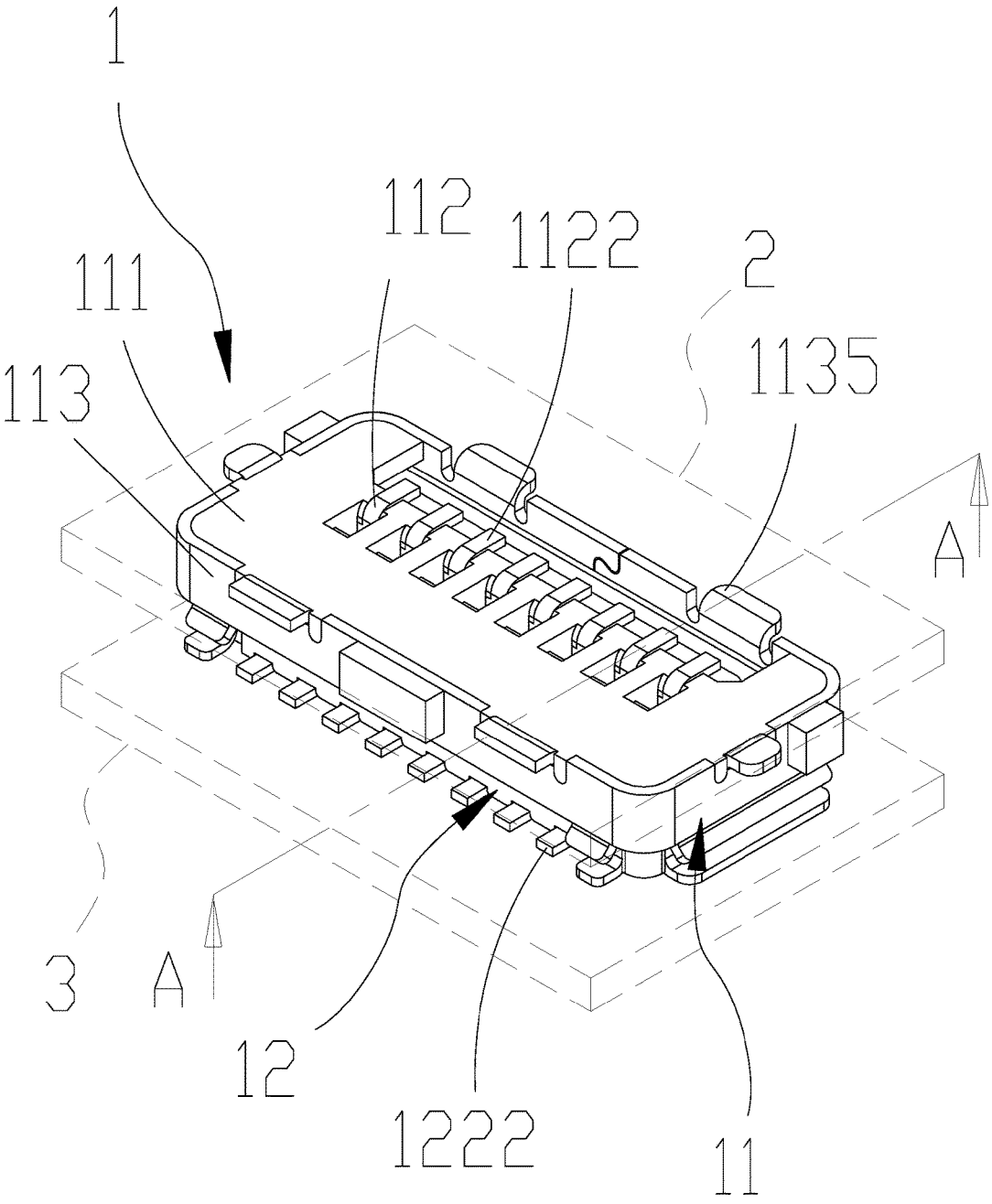
FIG. 1 is a schematic diagram showing an embodiment of a board to board connector assembly of the invention.

Embodiments of the present invention will now be described in detail with reference to the accompanying drawings. The invention may, however, be embodied in many different forms and should not be construed as being limited to the embodiments set forth herein. Rather, these embodiments are provided so that this disclosure will be thorough and complete, and will fully convey the scope of the invention to those skilled in the art. In the drawings, the shapes and dimensions of elements may be exaggerated for clarity, and the same reference numerals will be used throughout to designate the same or like components.

The invention is to provide a board to board connector assembly, which includes a male board connector, a female board connector, and an engagement structure for effectively engaging the male board connector with the female board connector. This assures effective engagement between the female and male board connectors, such that height of engagement between the female and male board connectors can be reduced desirably, making the board to board connector assembly well applicable to various miniaturized electronic devices. Moreover, the board to board connector assembly of the invention includes a plurality of conductors for simultaneously transmitting various signals, such that the number of connectors used in the electronic devices can be reduced. This also allows the board to board connector assembly to be readily applied to various miniaturized electronic devices.

A board to board connector assembly proposed in the invention is described as follows according to embodiments disclosed in FIGS. 1 to 13.

Figure 2:
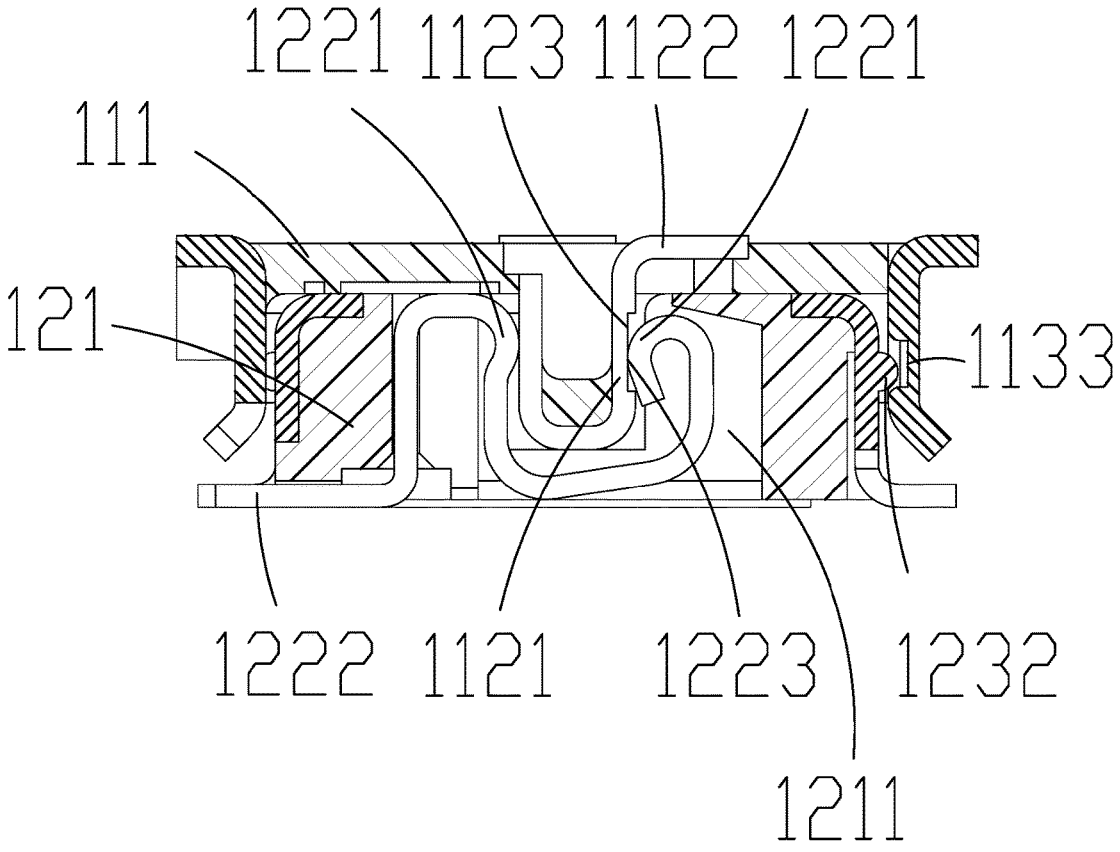
FIG. 2 is a cross-sectional view of the board to board connector assembly of FIG. 1 along line AA.
Figure 3:
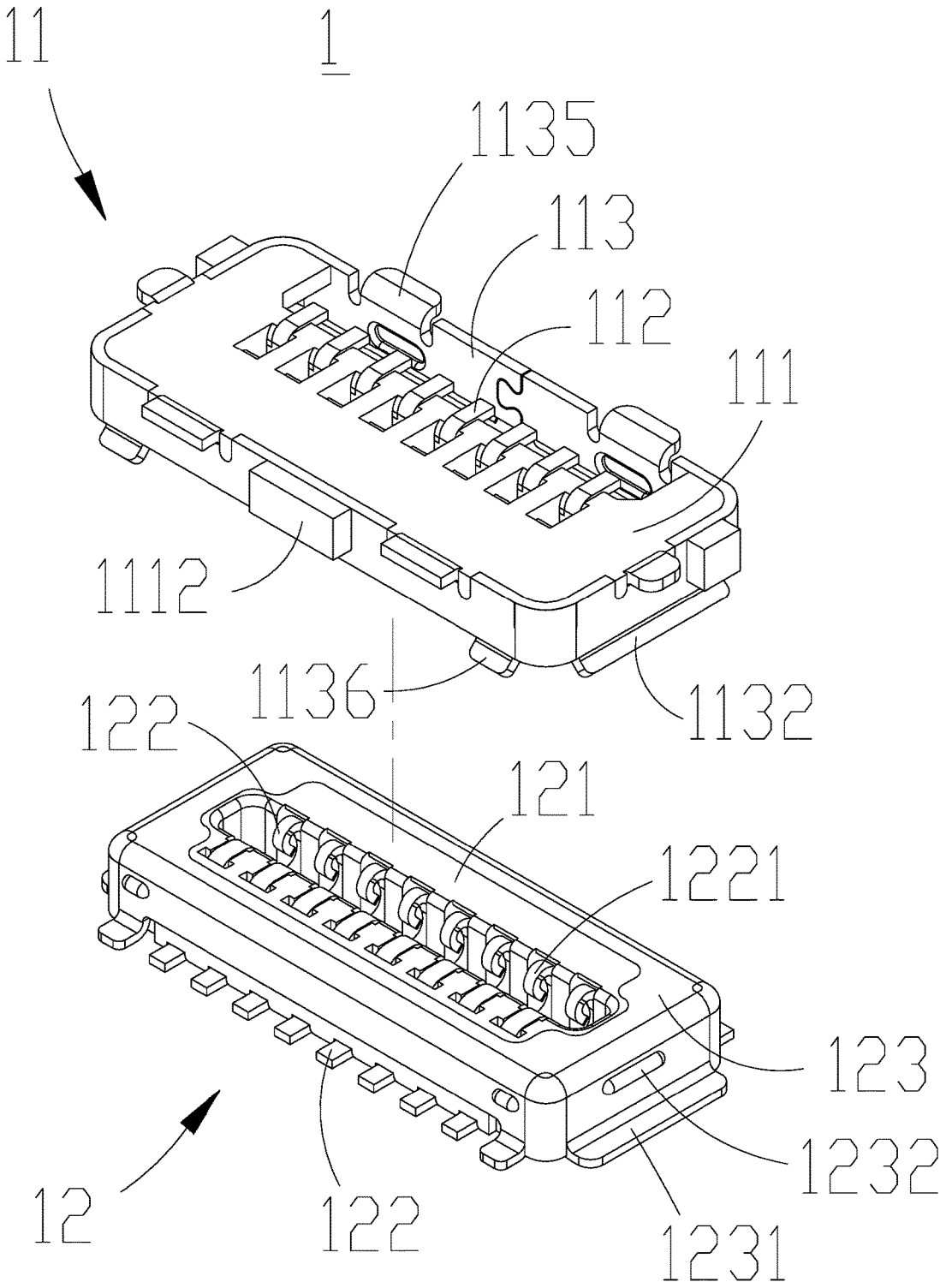
FIG. 3 is a breakdown diagram of the board to board connector assembly of FIG. 1.

As shown in FIGS. 1 to 3, the board to board connector assembly 1 includes a male board connector 11 and a female board connector 12, which are rectangular bodies. The male board connector 11 includes a male insulator 111, a plurality of male conductors 112, and a male shield 113. The plurality of male conductors 112 and the male shield 113 can be respectively soldered to a first circuit substrate 2. The female board connector 12 includes a female insulator 121, a plurality of female conductors 122, and a female shield 123. The plurality of female conductors 122 and the female shield 123 can be respectively soldered to a second circuit substrate 3. Therefore, the board to board connector assembly 1 of the invention allows signal transmission between the first circuit substrate 2 and the second circuit substrate 3.

In this embodiment, the male board connector 11 has eight male conductors 112, and the female board connector 12 has eight female conductors 122. When the board to board connector assembly is applied to a mobile communication device, two sets of radio frequency signals and a set of USB type C 3.1 signals can be transmitted at the same time, instead of using two sets of radio frequency connectors and a set of USB connectors, such that the number of connectors used in an electronic device can be reduced, and the board to board connector assembly is suitable for a miniaturized electronic device.

The male board connector in this embodiment is shown in FIGS. 4 to 7. Each of the plurality of male conductors 112 is formed with a male conductor matching portion 1121 and a male conductor soldering portion 1122. The male conductor matching portions 1121 of the male conductors 112 are used to match the female conductors 122, for providing signal transmission between the male conductors 112 and the female conductors 122. The male conductor soldering portions 1122 of the male conductors 112 are for being soldered to the first circuit substrate 2, for providing signal transmission between the male conductors 112 and the first circuit substrate 2. The male shield 113 includes a male shield engaging portion 1134.

The male insulator 111 can be formed with a male insulator engaging portion 1112 by embedded injection molding, for being engaged with the male shield engaging portion 1134 of the male shield 113. That is, structural matching between the male insulator engaging portion 1112 and the male shield engaging portion 1134 allows the male insulator 111 to be engaged with the male shield 113. In this embodiment, the male insulator engaging portion 1112 includes a plurality of male insulator engaging blocks respectively provided on a plurality of outer peripheral walls of the male insulator 111, and the male shield engaging portion 1134 includes a plurality of male shield engaging slots respectively provided on a plurality of inner peripheral walls of the male shield 113. However, it should be understood that the number of male insulator engaging blocks and the number of male shield engaging slots are not limited to those in this embodiment, but are flexible (not excluding odd numbers) as long as they may achieve effective engagement between the male insulator 111 and the male shield 113.

Further in this embodiment, the male conductors 112 are embedded in the male insulator 111 by embedded injection molding in a manner that, the male conductor matching portions 1121 are exposed from a top side of the male insulator 111 and the male conductor soldering portions 1122 are extended out of a bottom side of the male insulator 111. The male insulator 111 is also formed with a protruded male insulator supporting portion 1111 by embedded injection molding in a manner that, the male conductor matching portions 1121 cross above the male insulator supporting portion 1111, and the male insulator supporting portion 1111 provides support for the male conductor matching portions 1121, such that the male conductor matching portions 1121 remain protruded on the male insulator 111 and would not become deformed by any force at the time when they are matching the female conductors 122.

Figure 4:
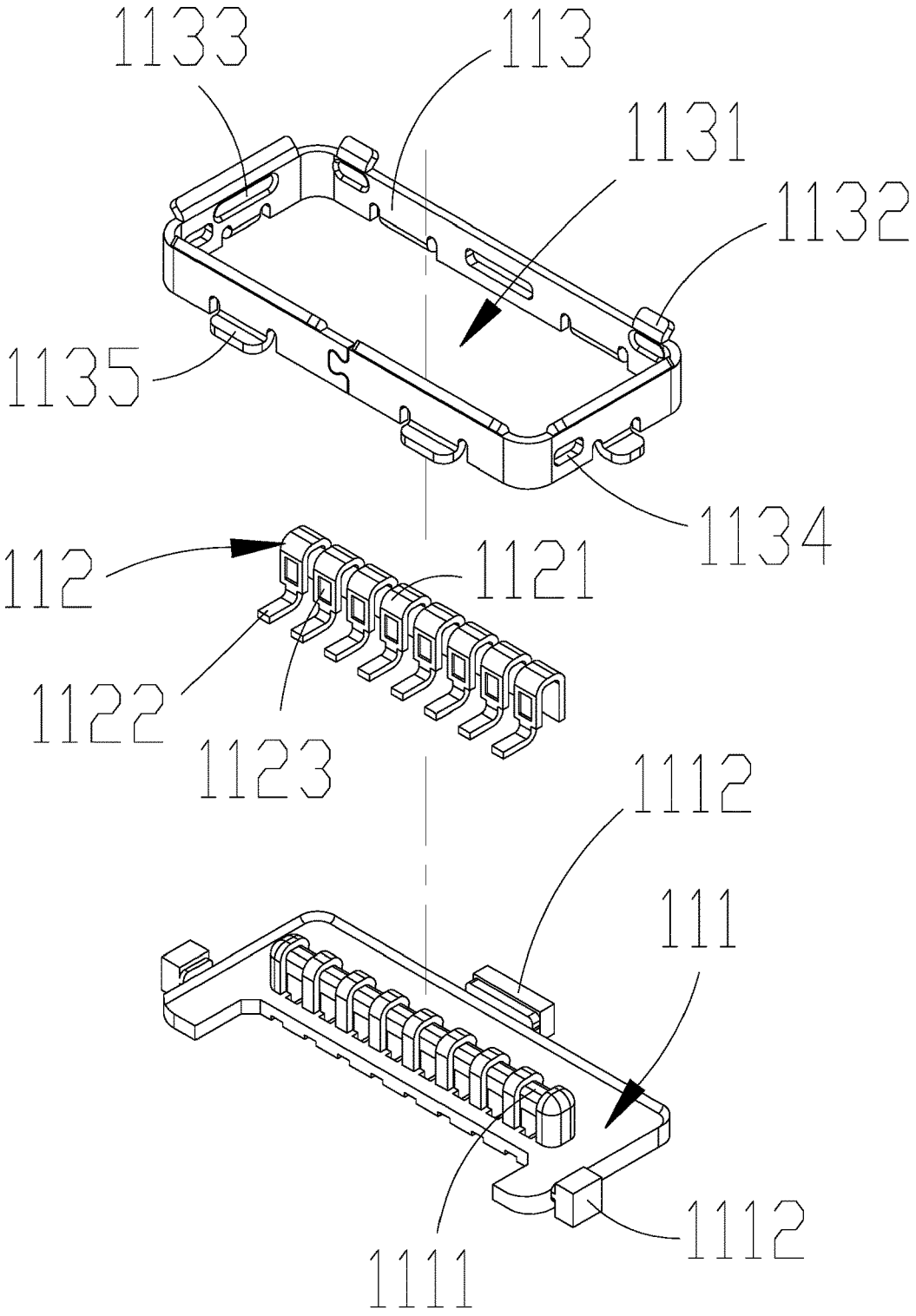
FIG. 4 is a breakdown diagram of a male board connector shown in FIG. 3.
Figure 5:
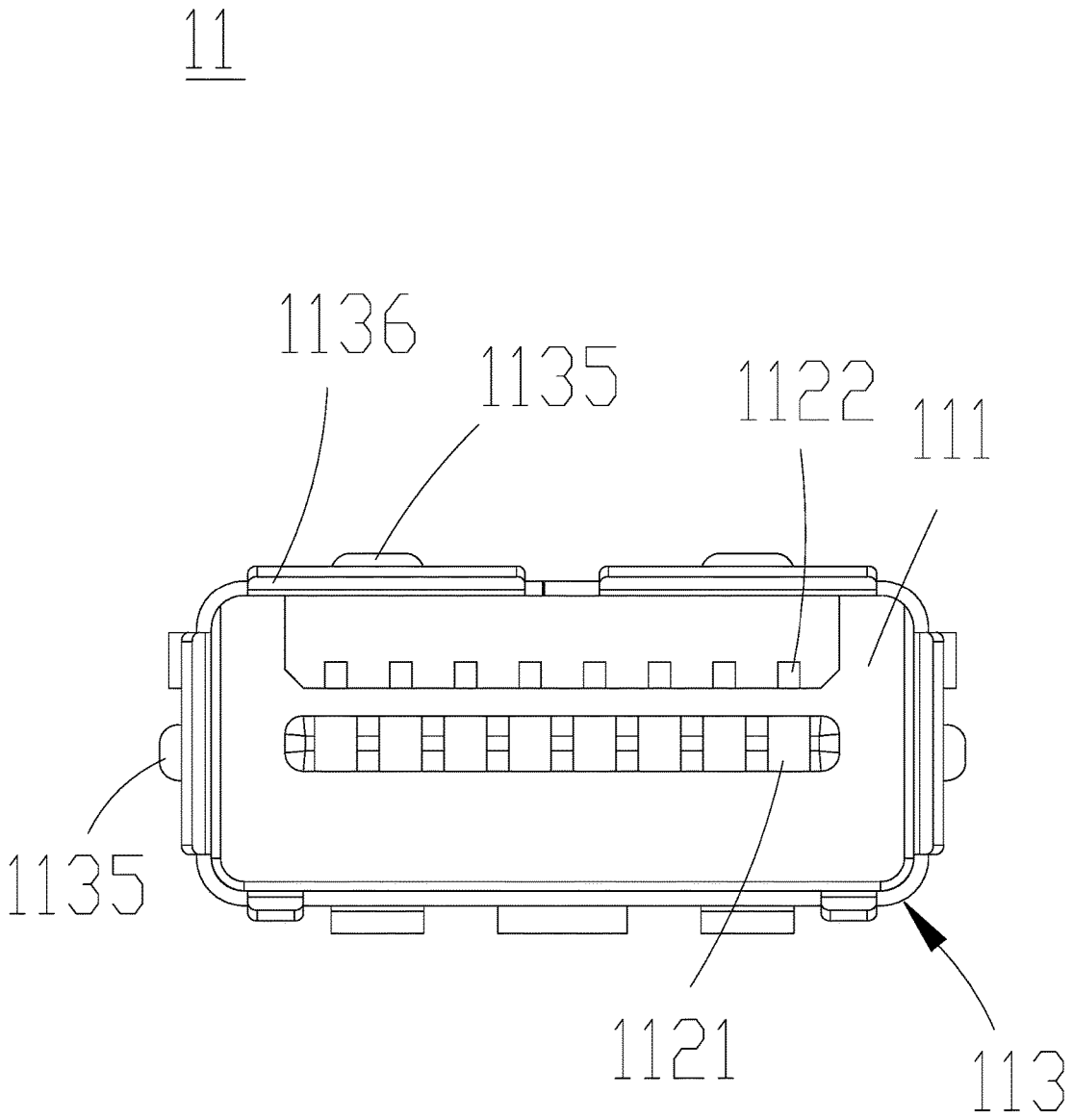
FIG. 5 is a bottom view of the male board connector shown in FIG. 3.
Figure 6:
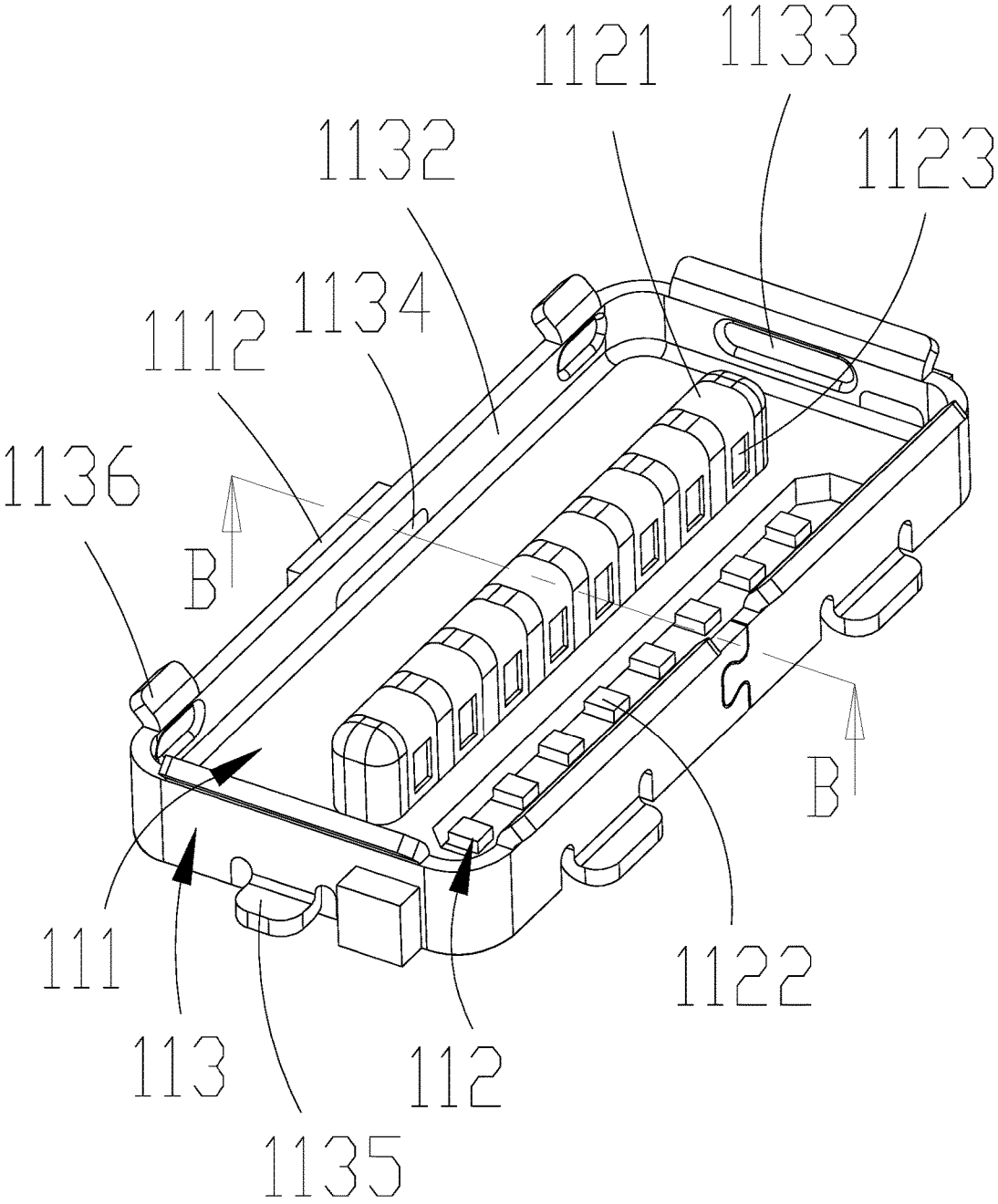
FIG. 6 is another angle view of the male board connector shown in FIG. 3.
Figure 7:
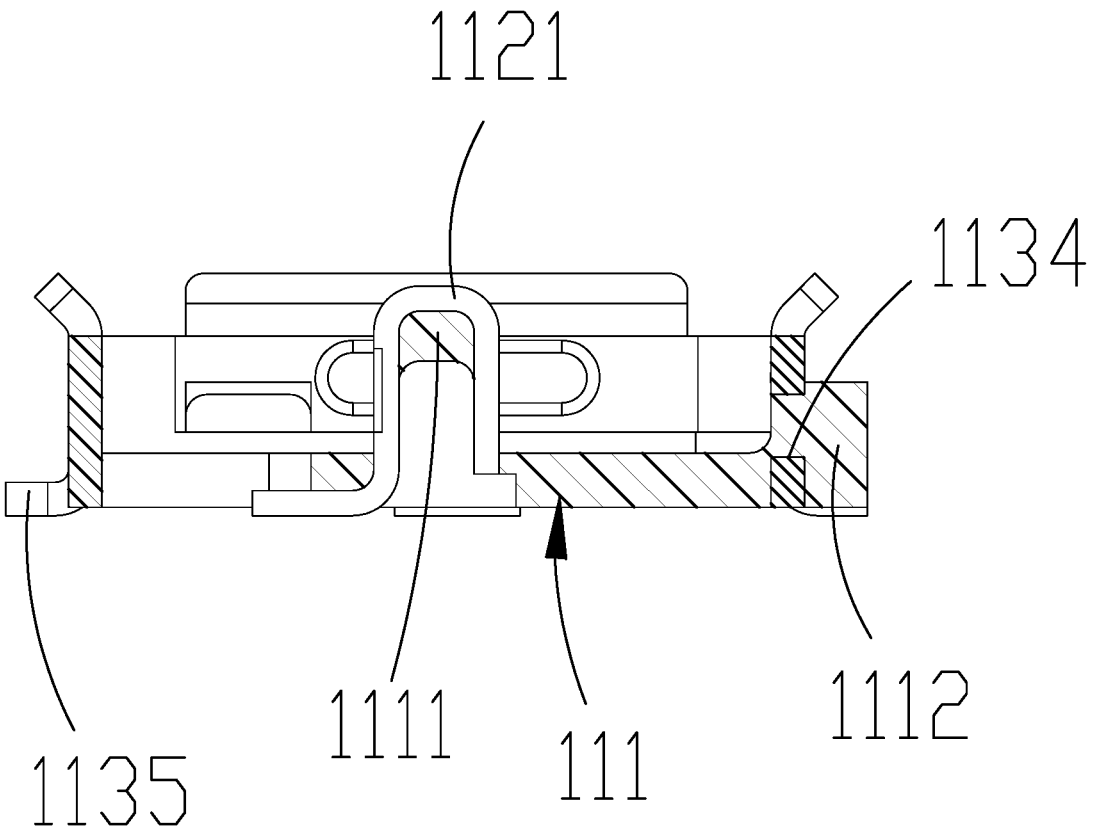
FIG. 7 is a cross-sectional view of the male board connector of FIG. 6 along line BB.
Figure 8:
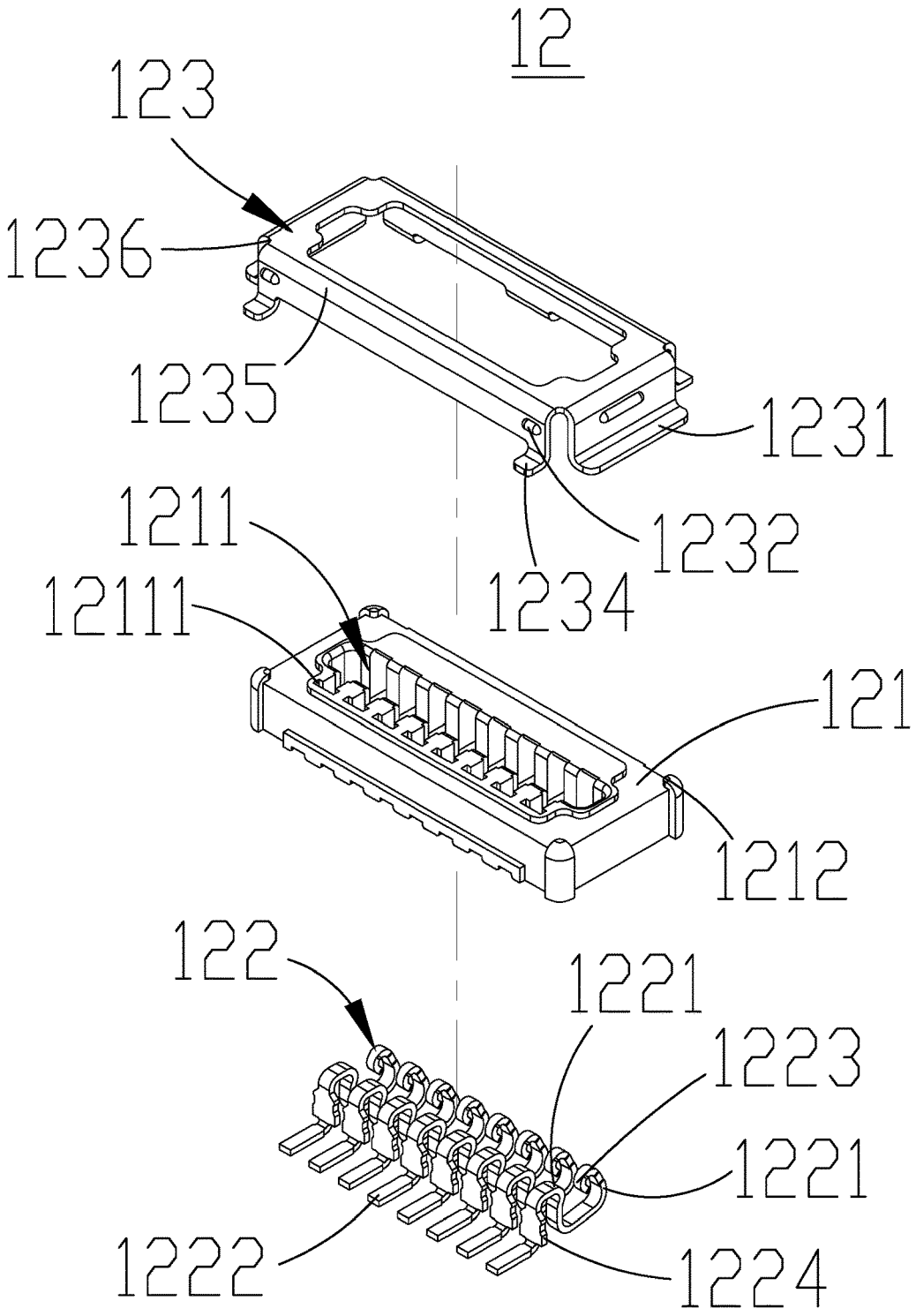
FIG. 8 is a breakdown diagram of a female board connector shown in FIG. 3.
Figure 9:
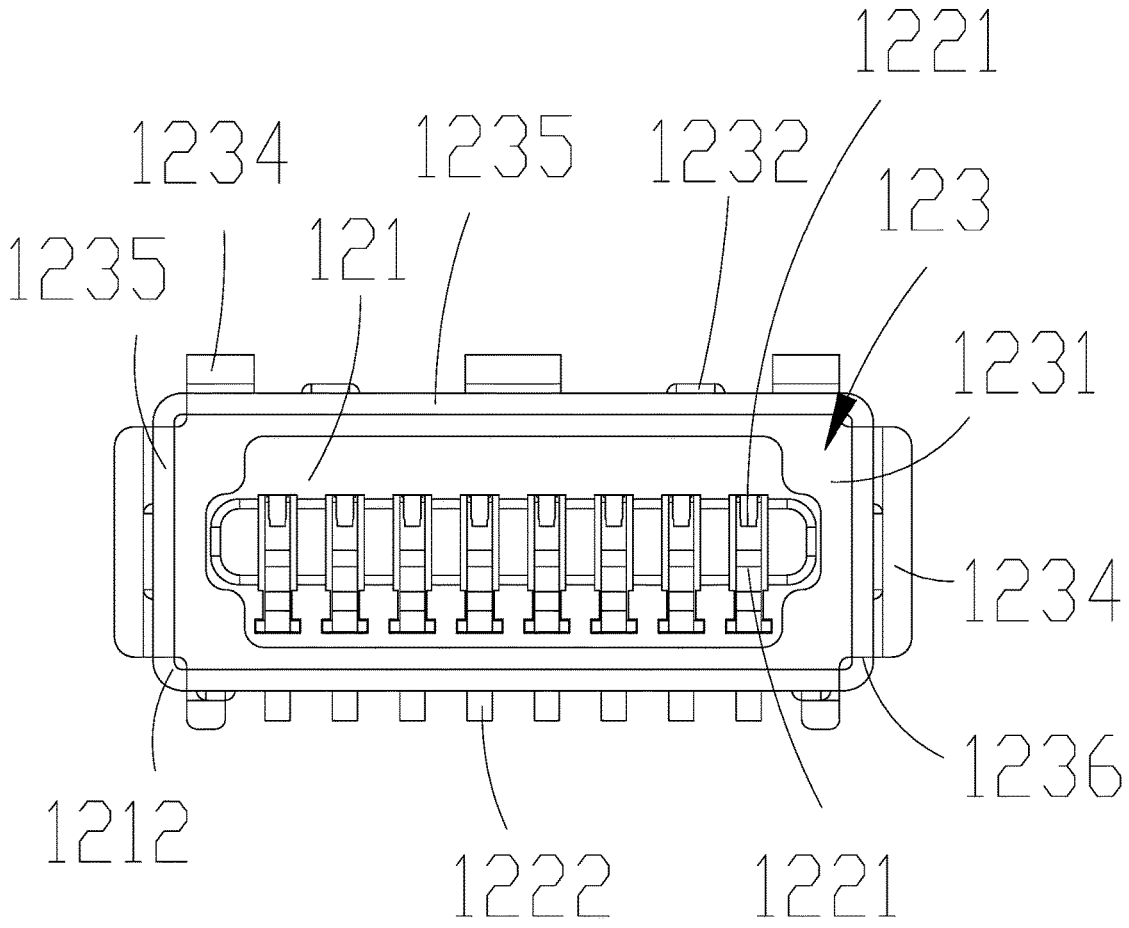
FIG. 9 is a top view of the female board connector shown in FIG. 3.
Figure 10:
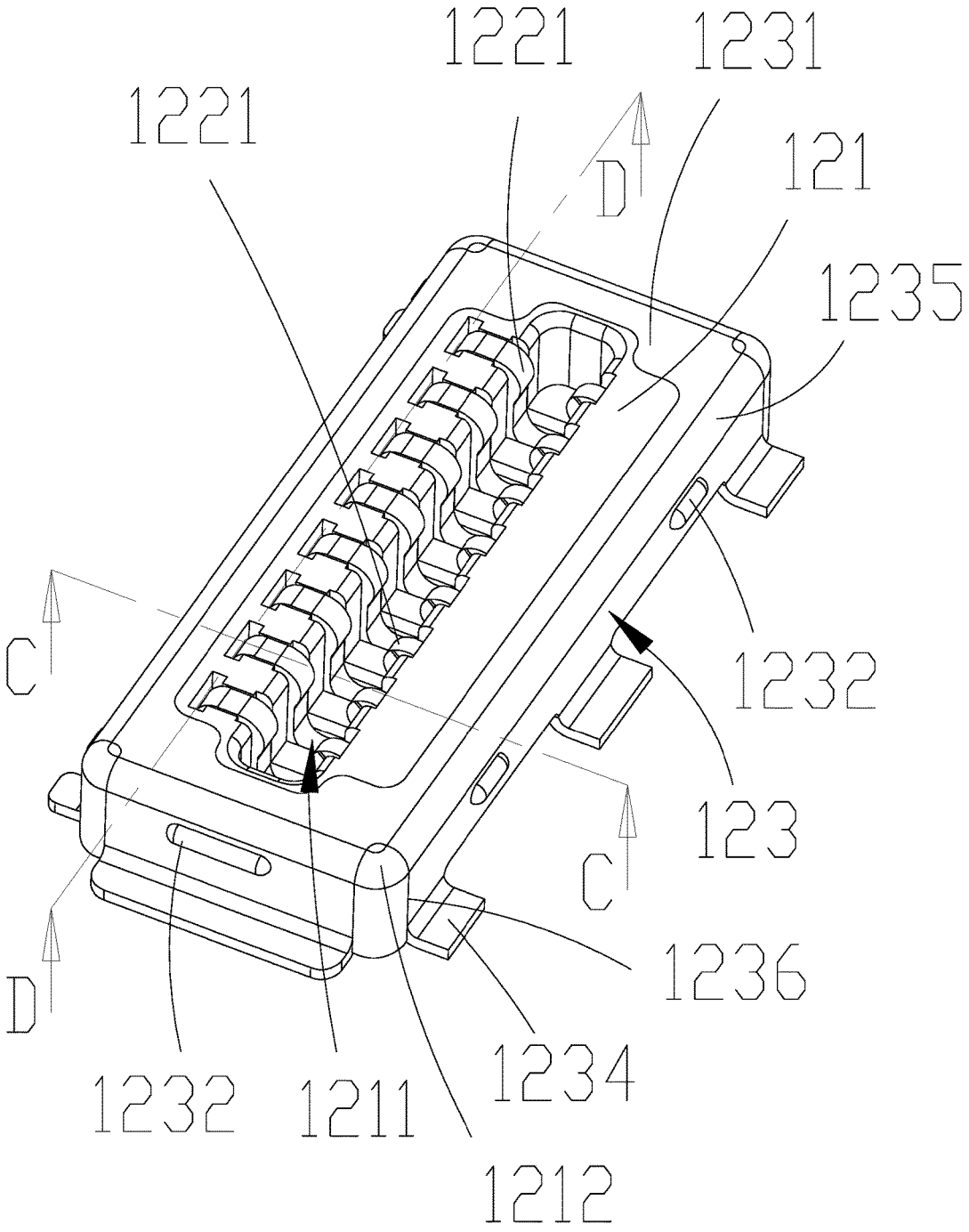
FIG. 10 is another angle view of the female board connector shown in FIG. 3.
Figure 11:
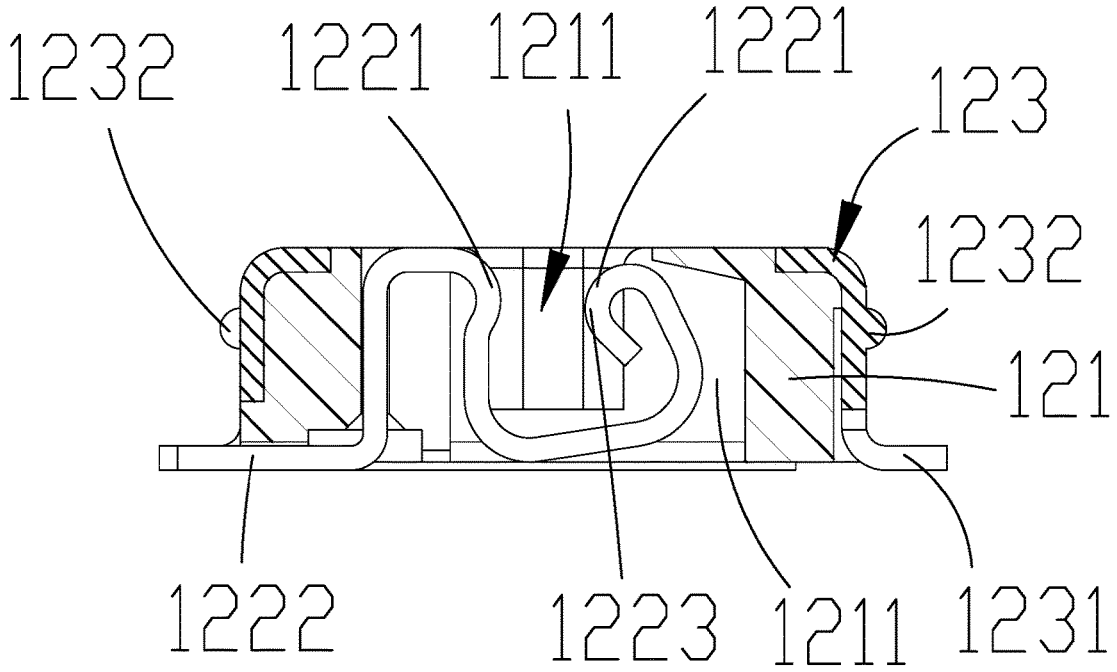
FIG. 11 is a cross-sectional view of the female board connector of FIG. 10 along line CC.
Figure 12:
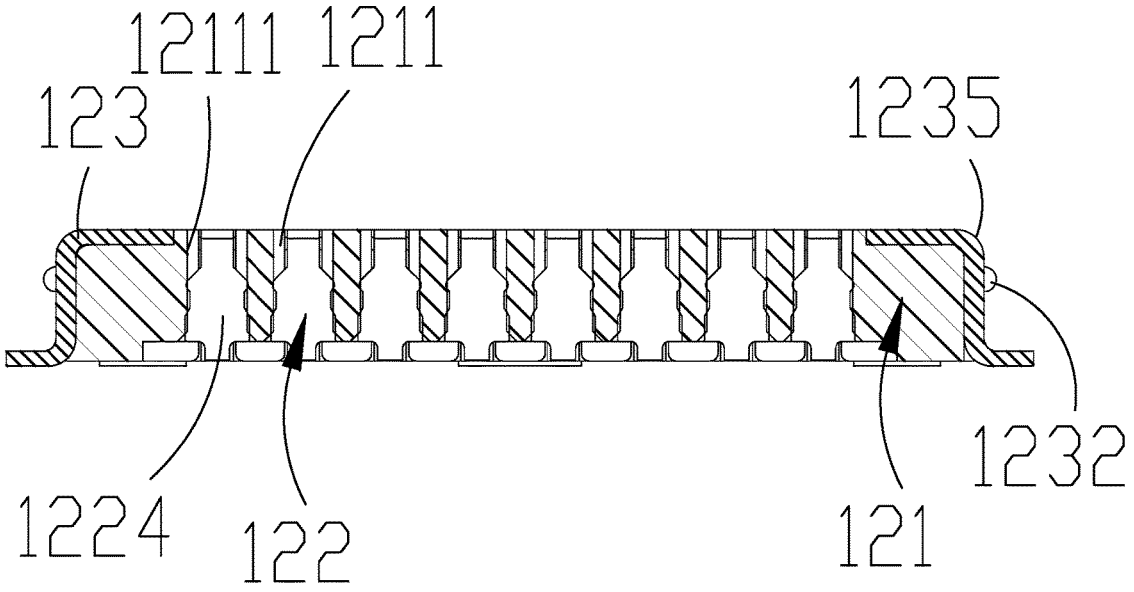
FIG. 12 is a cross-sectional view of the female board connector of FIG. 10 along line DD.

The male shield 113 is extended peripherally around the male insulator 111. In this embodiment, the area surrounded by the male shield 113 is named "male shielding area 1131", and the male shield 113 shields the male shielding area 1131. As shown in FIG. 4, the male shield 113 includes a male shield matching portion 1132, a male shield coupling portion 1133, and a male shield soldering portion 1135. The male shield soldering portion 1135 is for being soldered to the first circuit substrate 2, so as to provide signal transmission between the male shield 113 and the first circuit substrate 2. In this embodiment, the male conductor soldering portions 1122 are extended into the male shielding area 1131, such that the male shield 113 provides shielding and protects signal transmission against external interference. Moreover, the invention has, but is not limited to, the male shield soldering portion 1135 extended out of the male shielding area 1131 to be easily soldered to the first circuit substrate 2.

The female board connector in this embodiment is shown in FIGS. 8 to 12. Each of the female conductors 122 includes a female conductor matching portion 1221, a female conductor soldering portion 1222 and a female conductor coupling portion 1224. The female conductor matching portions 1221 of the female conductors 122 are used to match the male conductors 112, for providing signal transmission between the female conductors 122 and the male conductors 112. The female conductor soldering portions 1222 of the female conductors 122 are for being soldered to the second circuit substrate 3, for providing signal transmission between the female conductors 122 and the second circuit substrate 3. The female conductor coupling portions 1224 of the female conductors 122 are for being coupled to the female insulator 121, so as to allow the female conductors 122 to be coupled to and positioned by the female insulator 121. The female shield 123 includes a female shield soldering portion 1234 and a female shield engaging portion 1236. The female shield soldering portion 1234 is for being soldered to the second circuit substrate 3, so as to allow signal transmission between the female shield 123 and the second circuit substrate 3.

The female insulator 121 is formed with a female insulator engaging portion 1212 by embedded injection molding, for being engaged with the female shield engaging portion 1236 of the female shield 123. That is, structural matching between the female insulator engaging portion 1212 and the female shield engaging portion 1236 allows the female insulator 121 to be engaged with the female shield 123. In this embodiment, the female insulator engaging portion 1212 includes a plurality of female insulator engaging blocks respectively provided on a plurality of outer peripheral walls of the female insulator 121 or provided on a plurality of peripheral corners of the female insulator 121, and the female shield engaging portion 1236 includes a plurality of female shield engaging slots respectively provided on a plurality of inner peripheral walls of the female shield 123 or provided on a plurality of peripheral corners of the female shield 123. However, it should be understood that the number of female insulator engaging blocks and the number of female shield engaging slots are not limited to those in this embodiment, but are flexible (not excluding odd numbers) as long as they may achieve effective engagement between the female insulator 121 and the female shield 123.

In this embodiment, the female insulator 121 is further formed with a female insulator penetrating portion 1211 by embedded injection molding, wherein the female insulator penetrating portion 1211 has a coupling wall 12111. The female conductor coupling portions 1224 of the female conductors 122 are protruded coupling blocks, such that the female conductors 122 may be inserted into the female insulator penetrating portion 1211 and coupled to the female insulator 121 by structural matching between the coupling blocks and the coupling wall 12111, thereby making the female insulator 121 achieve coupling and positioning of the female conductors 122.

When the female conductors 122 are inserted into the female insulator penetrating portion 1211, the female conductor matching portions 1221 are exposed from a top side of the female insulator 121, and the female conductor soldering portions 1222 are extended out of a bottom side of the female insulator 121. The female shield 123 is extended peripherally around the female insulator 121. In this embodiment, the area surrounded by the female shield 123 is named "female shielding area 1233", and the female shield 123 shields the female shielding area 1233. The female shield 123 includes a female shield matching portion 1231 and a female shield coupling portion 1232. In this embodiment, the invention has, but is not limited to, the female conductor soldering portions 1222 and the female shield soldering portion 1234 both extended out of the female shielding area 1233 to be easily soldered to the second circuit substrate 3.

Figure 13:
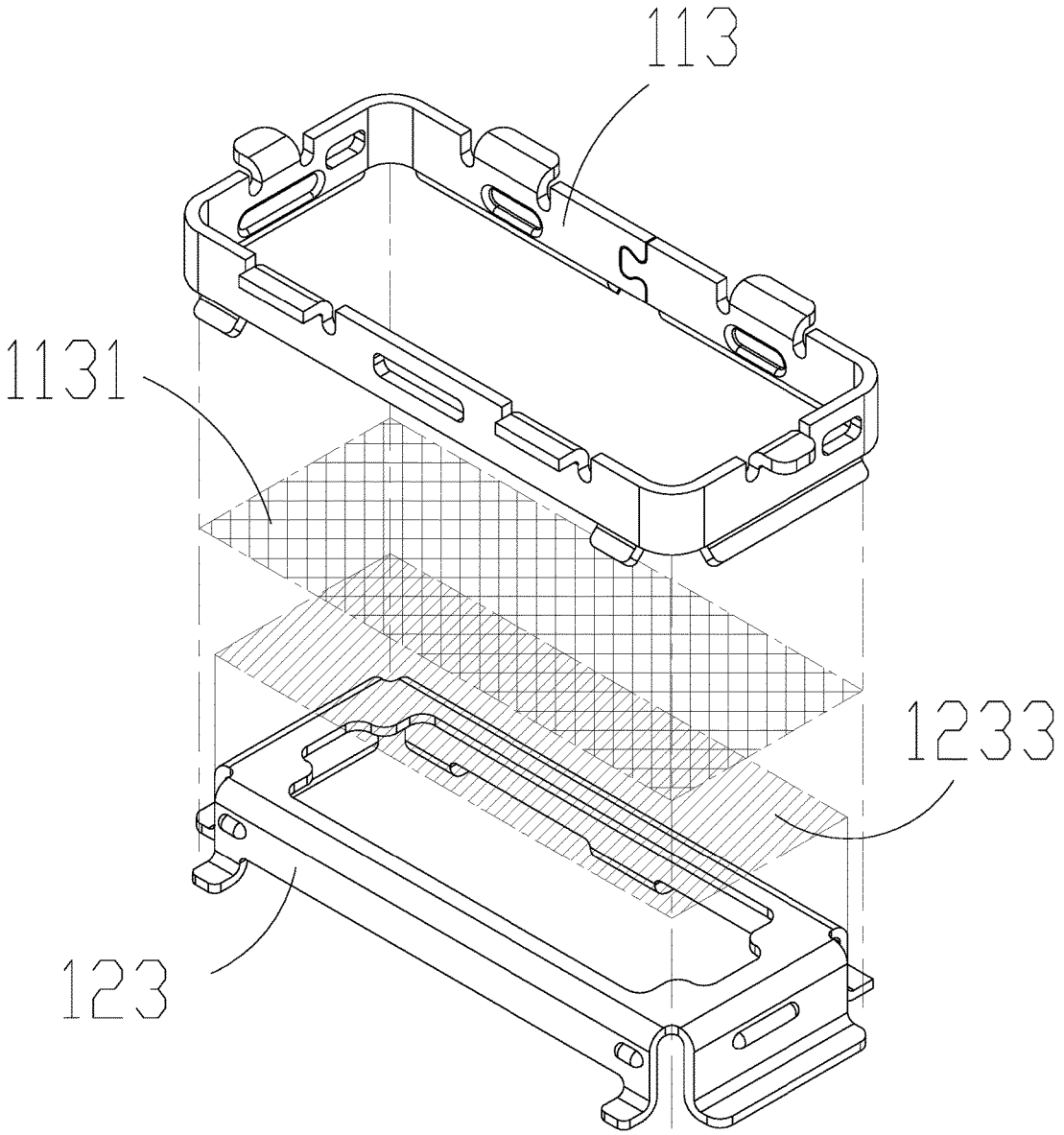
FIG. 13 is a schematic diagram showing a male shielding area and a female shielding area according to an embodiment of the board to board connector assembly of the invention.

Moreover, as shown in FIG. 13, the male shielding area 1131 is larger than the female shielding area 1233, and thus the male shield 113 may shield the female shield 123 so as to reduce any influence thereon from external electrical interference. The male shield coupling portion 1133 includes a plurality of male shield coupling slots formed on inner peripheral walls of the male shield 113, and the female shield coupling portion 1232 includes a plurality of female shield coupling blocks formed on outer peripheral walls of the female shield 123. The structural matching between the male shield coupling slots and the female shield coupling blocks allows the male shield coupling portion 1133 to be coupled to the female shield coupling portion 1232, such that the male shield 113 can be effectively coupled to the female shield 123. By the coupling mechanism the male board connector 11 can be effectively engaged with the female board connector 12 even if there is not sufficient contact area therebetween. Therefore the height of engagement between the male and female board connectors 11, 12 can be significantly reduced, making the board to board connector assembly of the invention well applicable to miniaturized electronic devices. It should be noted that, the number of male shield coupling slots and the number of female shield coupling blocks are not limited to "plurality" but may also be odd numbers as long as effective coupling between the male shield 113 and the female shield 123 is achieved.

In this embodiment, the male conductors 112 further include male conductor coupling portions 1123 (for example, male conductor coupling slots), and the female conductors 122 further include female conductor coupling portions 1223 (for example, female conductor coupling blocks). The male conductor coupling portions 1123 structurally match the female conductor coupling portions 1223, allowing the male conductors 112 to be effectively coupled to the female conductors 122. This also helps achieve effective engagement between the male and female board connectors 11, 12 in the case of insufficient contact area therebetween, and thus further reduces the height of engagement between the male and female board connectors 11, 12.

The male shield 113 further includes a male shield guiding portion 1136, and the female shield 123 further includes a female shield guiding portion 1235. There is structural matching between the male shield guiding portion 1136 and the female shield guiding portion 1235, which guides the male board connector 11 to a way for being inserted to the female board connector 12 by coupling the male shield coupling portion 1133 to the female shield coupling portion 1232, matching the male conductor matching portions 1121 with the female conductor matching portions 1221 and matching the male shield matching portion 1132 and the female shield matching portion 1231, such that the male board connector 11 is electrically connected to the female board connector 12.

Therefore the invention provides a board to board connector assembly, which includes a male board connector, a female board connector, and an engagement structure for effectively engaging the male board connector with the female board connector even in the case of insufficient contact area therebetween, such that height of engagement between the female and male board connectors can be reduced significantly, making the board to board connector assembly well applicable to miniaturized electronic devices. Moreover, the board to board connector assembly of the invention includes a plurality of conductors for simultaneously transmitting various signals, such that the number of connectors used in the electronic devices can be reduced. This further assures the board to board connector assembly to be readily applied to various miniaturized electronic devices.

The examples above are only illustrative to explain principles and effects of the invention, but not to limit the invention. It will be apparent to those skilled in the art that modifications and variations can be made without departing from the scope of the invention. Therefore, the protection range of the rights of the invention should be as defined by the appended claims.

What is claimed is:

1. A board to board connector assembly for signal transmission between a first circuit substrate and a second circuit substrate, the board to board connector assembly including:

a male board connector, including:

a male insulator including a male insulator supporting portion, wherein the male insulator supporting portion prudes from a top surface of the male insulator and forms thereon a plurality of embedding grooves spaced apart from each other;

a plurality of male conductors, each of the male conductors including a male conductor matching portion and a male conductor soldering portion, wherein the male conductors are embedded in the male insulator, allowing the male conductor matching portions to be embedded into the corresponding embedding grooves on the male insulator supporting portion and to be exposed from a top side of the male insulator, and allowing the male conductor soldering portions to be extended out of a bottom side of the male insulator, wherein the male conductor soldering portions are for being soldered to the first circuit substrate, and the male insulator supporting portion supports the male conductor matching portions and allows them to remain protruded on the male insulator; and a male shield coupled to the male insulator and forming a male shielding area surrounding peripherally the male insulator, the male shield including a male shield matching portion, a male shield coupling portion and a male shield soldering portion, wherein the male shield soldering portion is for being soldered to the first circuit substrate, the male conductor soldering portions are extended within the male shielding area, and the male shield soldering portion is extended out of the male shielding area, such that the male shield fully covers the male conductor soldering portions to achieve shielding effect; and a female board connector, including:

a female insulator including a female insulator penetrating portion;

a plurality of female conductors, each of the female conductors including a female conductor matching portion and a female conductor soldering portion, wherein the female conductors are inserted into the female insulator penetrating portion, allowing the female conductor matching portions to be exposed from a top side of the female insulator, and allowing the female conductor soldering portions to be extended out of a bottom side of the female insulator, wherein the female conductor soldering portions are for being soldered to the second circuit substrate; and a female shield embedded in the female insulator and surrounding periphery and a top surface of the female insulator, the female shield including a female shield matching portion, a female shield coupling portion and a female shield soldering portion, wherein the female shield soldering portion is for being soldered to the second circuit substrate, and the female shield matching portion is formed as a circled plate surrounding the female conductor matching portions and covering the top surface of the female insulator;

wherein, the male board connector is inserted to the female board connector, wherein the male shield coupling portion is coupled to the female shield coupling portion, the male conductor matching portions match the female conductor matching portions, and the male shield matching portion matches the female shield matching portion, so as to allow the male board connector to be electrically connected to the female board connector, wherein the female shield further includes a female shield engaging portion, and the female insulator further includes a female insulator engaging portion that structurally matches the female shield engaging portion, so as to allow the female shield to be engaged with the female insulator, wherein the female shield engaging portion includes four female shield engaging slots formed at four corners of the female shield respectively, and the female insulator engaging portion is formed by injection molding with the female insulator and includes four female insulator engaging blocks that structurally matches the four female shield engaging slots, so as to allow the female shield engaging portion to be engaged with the female insulator engaging portion, wherein the male shield coupling portion includes at least one male shield coupling slot on each wall of the male shield, and the female shield coupling portion includes at least one female shield coupling block on each outer peripheral wall of the female shield, and each of the female shield coupling block structurally matches the at least one male shield coupling slot, so as to allow the male shield coupling portion to be coupled to the female shield coupling portion, wherein each of the plurality of male conductors includes at least one male conductor coupling slot, and each of the plurality of female conductors includes at least one female conductor coupling block that structurally matches the at least one male conductor coupling slot, and wherein two side walls are formed on both sides of the at least one male conductor coupling slot respectively to prevent the corresponding female conductor coupling block from electrically connecting to the adjacent male conductor coupling slots.

2. The board to board connector assembly according to claim 1, wherein each of the female conductors includes a female conductor coupling portion for being coupled to the female insulator.

3. The board to board connector assembly according to claim 2, wherein the female conductor coupling portions of the female conductors are coupling blocks protruded from the female conductors, and the female insulator penetrating portion includes a coupling wall that structurally matches the coupling blocks so as to allow the female conductors to be coupled to the female insulator.

4. The board to board connector assembly according to claim 1, wherein the female shield forms a female shielding area surrounding peripherally the male insulator, and the female conductor soldering portions and the female shield soldering portion are extended out of the female shielding area.

5. The board to board connector assembly according to claim 4, wherein the male shielding area is larger than the female shielding area.

6. The board to board connector assembly according to claim 1, wherein the at least one male shield coupling slot includes a plurality of male shield coupling slots respectively provided on inner peripheral walls of the male shield, and the at least one female shield coupling block includes a plurality of female shield coupling blocks respectively provided on outer peripheral walls of the female shield.

7. The board to board connector assembly according to claim 1, wherein the male shield further includes a male shield engaging portion, and the male insulator further includes a male insulator engaging portion that structurally matches the male shield engaging portion, so as to allow the male shield to be engaged with the male insulator.

8. The board to board connector assembly according to claim 7, wherein the male shield engaging portion includes at least one male shield engaging slot, and the male insulator engaging portion includes at least one male insulator engaging block that structurally matches the at least one male shield engaging slot, so as to allow the male shield engaging portion to be engaged with the male insulator engaging portion.

9. The board to board connector assembly according to claim 8, wherein the at least one male shield engaging slot includes a plurality of male shield engaging slots respectively provided on inner peripheral walls of the male shield, and the at least one male insulator engaging block includes a plurality of male insulator engaging blocks respectively provided on outer peripheral walls of the male insulator.

10. The board to board connector assembly according to claim 1, wherein the male board connector and the female board connector are rectangular bodies, wherein the male board connector includes eight male conductors, and the female board connector includes eight female conductors.

11. The board to board connector assembly according to claim 1, wherein the male shield further includes a male shield guiding portion, and the female shield further includes a female shield guiding portion that structurally matches the male shield guiding portion, so as to allow the male board connector to be guided and inserted to the female board connector.

* * * * *